US007424860B2

(12) United States Patent
Khuwaja

(10) Patent No.: US 7,424,860 B2
(45) Date of Patent: Sep. 16, 2008

(54) ROLLOVER BOAT

(76) Inventor: Zahid Kamal Khuwaja, Apartment 801, HSBC Bank Building, Airport Road, Abu Dhabi (AE)

( * ) Notice: Subject to any disclaimer, the term of this patent is extended or adjusted under 35 U.S.C. 154(b) by 0 days.

(21) Appl. No.: 11/392,048

(22) Filed: Mar. 29, 2006

(65) Prior Publication Data

US 2007/0099523 A1 May 3, 2007

Related U.S. Application Data

(60) Provisional application No. 60/596,933, filed on Oct. 31, 2005.

(51) Int. Cl.
*B63C 9/06* (2006.01)

(52) U.S. Cl. ..... 114/350; 114/360

(58) Field of Classification Search ..... 114/61.1, 114/61.11, 68, 350, 360, 363; 441/130
See application file for complete search history.

(56) References Cited

U.S. PATENT DOCUMENTS 1,130,301 A * 3/1915 La Fontaine ..... 114/350
1,711,726 A * 5/1929 Fogas ..... 114/68
2,382,126 A * 8/1945 Bitton ..... 114/350
4,928,620 A * 5/1990 Currey ..... 114/363
6,394,019 B1 * 5/2002 West ..... 114/350
6,718,903 B1 4/2004 Moïse et al.
6,739,278 B2 5/2004 Callahan
6,739,281 B1 5/2004 Grimes
6,830,003 B2 12/2004 Treadwell
6,886,490 B2 5/2005 Aubé et al.
6,889,625 B1 5/2005 Loffler
6,915,755 B2 7/2005 Ichihara et al.
6,948,445 B2 9/2005 Lewis
2002/0195040 A1 * 12/2002 Mucke ..... 114/350

* cited by examiner

*Primary Examiner*—Lars A Olson
(74) *Attorney, Agent, or Firm*—Laurence A. Greenberg; Werner H. Stemer; Ralph E. Locher

(57) ABSTRACT

A boat compensates for roll over conditions by maintaining a user in an upright position at all times. The boat contains an external frame, an internal frame disposed for moving within the external frame, and a seat assembly attached to the internal frame and maintained in an upright position by movement of the internal frame within the external frame. At least three buoyancy chambers are attached to the external frame.

16 Claims, 7 Drawing Sheets

ROLLOVER BOAT

CROSS-REFERENCE TO RELATED APPLICATION

This application claims the benefit under 35 U.S.C. § 119 (e) of provisional application No. 60/596,933, filed Oct. 31, 2005.

BACKGROUND OF THE INVENTION

Field of the Invention

The invention relates, generally, to boats, and more specifically, it relates to a boat that can compensate for roll over conditions without adversely affecting a seated user.

In a typical boat, seats are firmly attached to a frame of the boat for securely seating the users. However, should the boat roll over, neither the seat nor the boat compensates for the roll over effect and generally capsizes. One type of such a boat is a pontoon-type watercraft that is usually equipped with an outboard motor, typically operates at slower speeds, and generally offers a more relaxed ride. Conventionally, seats are fixedly disposed on the deck of the pontoon-type watercraft for cruising and for accommodating a variety of other aquatic activities in space and comfort. Because of the two pontoons, the pontoon boat is generally more stable than conventional speedboats, however, they too are susceptible to capsizing under certain conditions. Furthermore, as the seats are firmly connected to the frame of the pontoon boat, they also do not compensate for a capsizing condition.

The need exists particularly in extremely choppy conditions, such as in white water conditions, for a more stable boat that can automatically compensate for roll over conditions without adversely affecting the user.

SUMMARY OF THE INVENTION

It is accordingly an object of the invention to provide a rollover boat, which overcomes the herein-mentioned disadvantages of the heretofore-known devices of this general type, which compensates for roll over conditions.

With the foregoing and other objects in view there is provided, in accordance with the invention, a boat. The boat contains an external frame, an internal frame disposed for moving within the external frame, a seat assembly attached to the internal frame and maintained in an upright position by movement of the internal frame within the external frame, and at least three buoyancy chambers attached to the external frame.

In accordance with an added feature of the invention, the number of buoyancy chambers can be 4, 5, 6, 7 and 8. Ideally, the number is four.

In accordance with a further feature of the invention, the buoyancy chambers are inflatable buoyancy chambers. Alternatively, the buoyancy chambers are solid buoyancy chambers. Solid buoyancy chambers are more robust than inflatable buoyancy chambers but are heavier and less compact than inflatable buoyancy chambers.

In accordance with another feature of the invention, the external frame contains two rings and cross members connecting the rings to each other forming a cylindrically shaped external frame. The rings are formed with inner channels and the internal frame has roller bearings running and guided in the inner channels.

In accordance with an additional feature of the invention, the external frame further has a plurality of buoyancy frames fixed on the rings for supporting the buoyancy chambers and further cross members connected between each pair of the buoyancy frames. Each of the buoyancy chambers has a least one releasable strap for releasably securing the buoyancy chambers to the further cross members. Ideally there are four straps for each buoyancy chamber.

In accordance with another added feature of the invention, the seat assembly is rotatably mounted on a floor of the internal frame. The seat assembly has a bottom revolving mechanism fixed to the floor and a seat supported by the bottom revolving mechanism. The bottom revolving mechanism has a flange attached to the floor and a support attached to the seat, the support rotates about the flange. The seat has a seat bottom and a seat back extending from the seat bottom. The seat assembly has an attachment attached to the seat bottom, and the support is connected to the attachment allowing the seat to rotate 360 degrees. In this manner, the user has a full panoramic view and can position himself/herself as desired.

In accordance with a further embodiment of the invention, the seat assembly contains a safety harness assembly attached to the seat for securing a user in position in the seat. The safety harness assembly has a safety harness hinged to the seat back and an armrest attached to and extending from a front portion of the seat bottom to the seat back. Ideally, both the safety harness and the armrest are padded. The safety harness assembly contains a locking mechanism for locking the safety harness to the armrest.

In accordance with a concomitant feature of the invention, the external frame and the internal frame are made from a suitable material such as, but not limited to, metals, plastics and composites.

Other characteristic features of the invention are set forth in the appended claims.

Although the invention is illustrated and described herein as embodied in a rollover boat, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
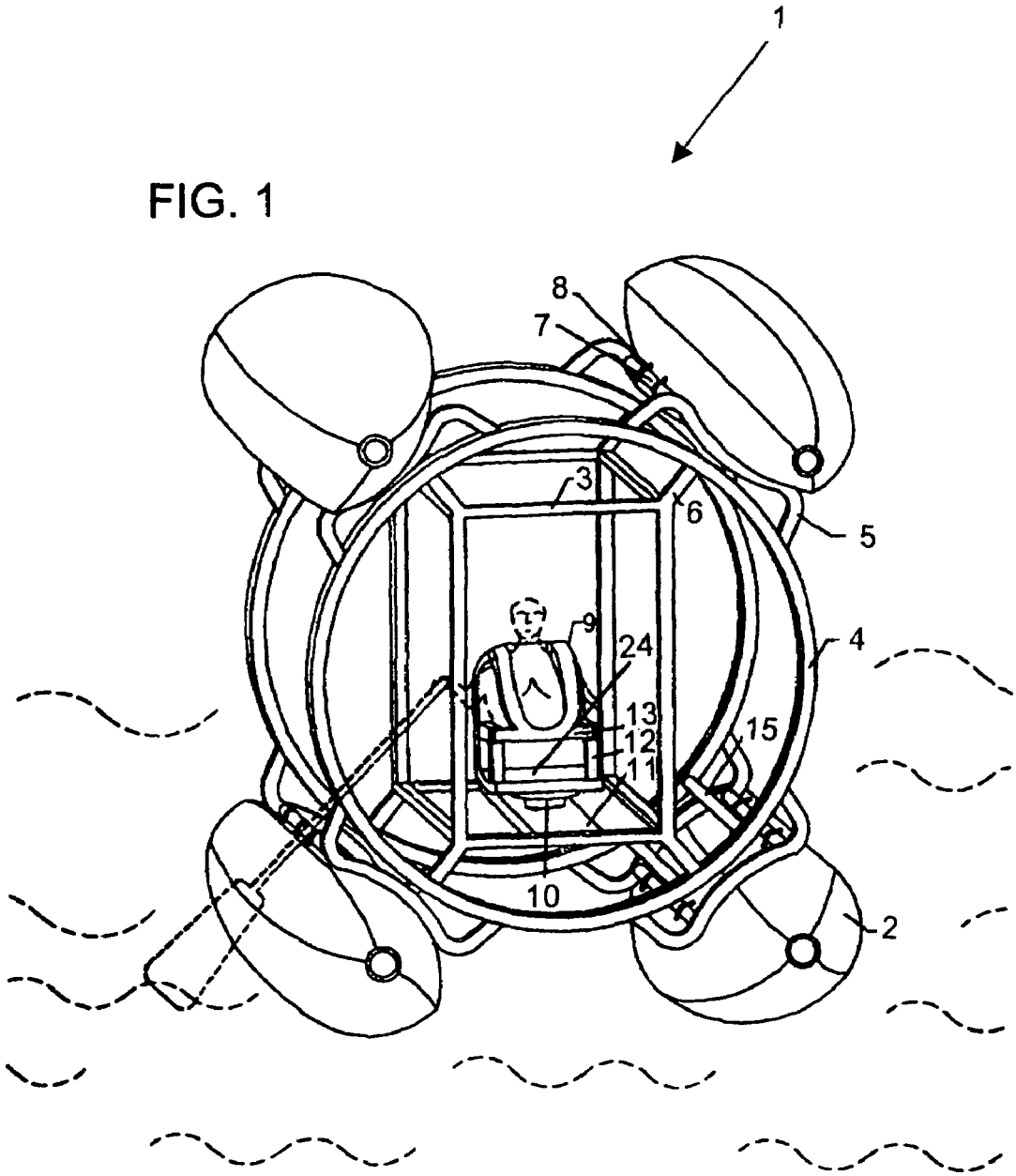
FIG. 1 is a diagrammatic, front perspective view of a rollover boat according to the invention.

In all the figures of the drawing, sub-features and integral parts that correspond to one another bear the same reference symbol in each case. Referring now to the figures of the drawings in detail and first, particularly, to FIG. 1 thereof, there is shown a rollover boat 1 containing four buoyancy chambers 2 each having a pontoon type shape. FIG. 1 shows four buoyancy chambers 2 but that number is arbitrary and could be 3, 5, 6, 7, 8 or greater. Preferably, the buoyancy chambers 2 are inflatable which makes the rollover boat 1 lighter, easier to store and easier to transport. Alternatively, the buoyancy chambers 2 can be solid and formed of a material such as plastic, plastic compounds, rubber, composite or other suitable materials. The buoyancy chambers 2 extend laterally to and spaced apart on a cylindrical shaped external framework 4, 5 formed of at least two rings 4 spaced apart from each other. A buoyancy framework 5 connects each of the buoyancy chambers 2 to the rings 4. The four buoyancy chambers 2 are spaced apart equally along the rings 4 but this equal spacing is not necessary as variations from a 90 degrees spacing is possible. Of course the spacing will also vary in dependency on the number of buoyancy chambers 2. The buoyancy chambers 2 each have a plurality of releasable straps 8 secured around a cross member 7 interconnecting two buoyancy frameworks 5. In this manner the buoyancy chambers 2 can be quickly changed out or removed for storage.

Figure 7:
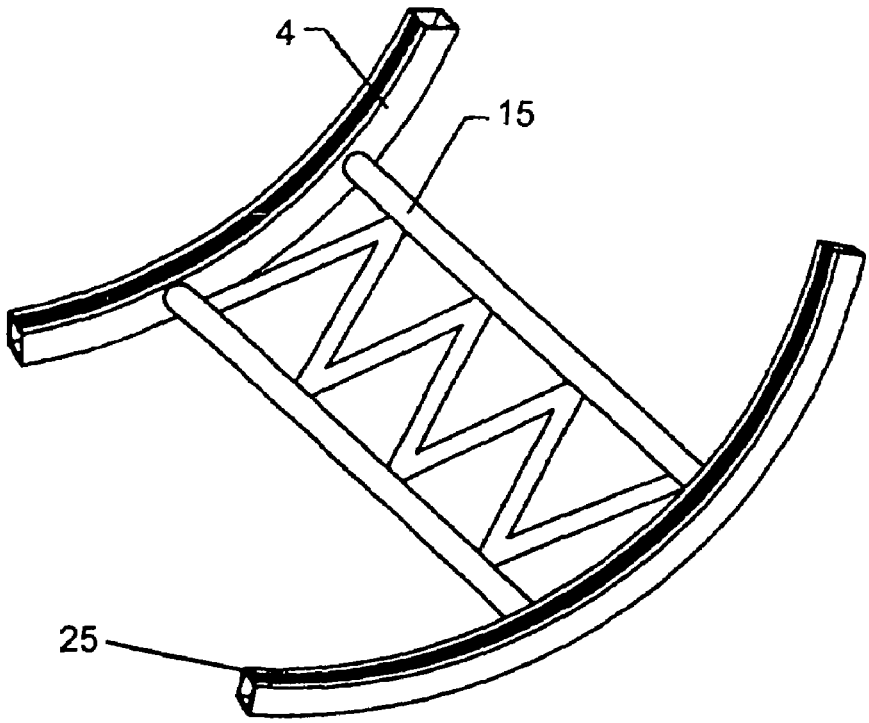
FIG. 7 is a diagrammatic, perspective view of a part of a frame of the rollover boat.
Figure 8:
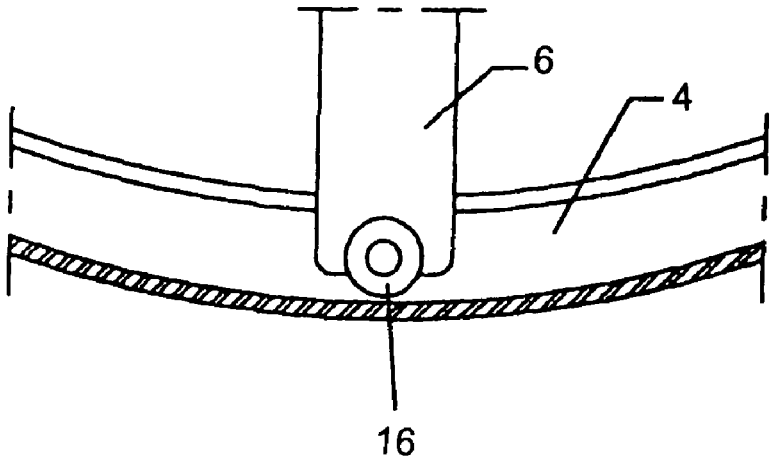
FIG. 8 is a diagrammatic, sectional view illustrating an inner channel or running track.
Figure 9:
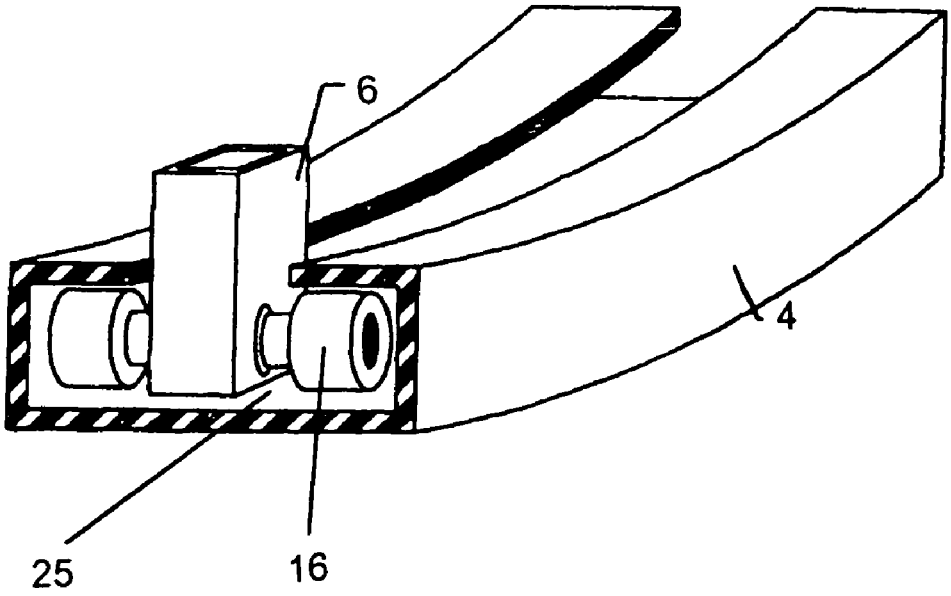
FIG. 9 is a diagrammatic, perspective view of the inner channel.

As best seen in FIGS. 7-9, the rings 4 are connected by cross-members 15 and define a cylindrical shape. It is noted at this point that the invention could be formed of more than two rings 4. Each of the rings 4 has an inner channel 25 for receiving and guiding roller bearings 16. As seen best in FIGS. 1-3, a generally square or rectangular shaped internal frame 3 is provided and has extended portions 6. The roller bearings 16 are disposed on the extended portions 6 and are guided within the inner channels 25 of the rings 4. The inner channel 25 is formed to fully contain the roller bearings 16 and at the same time allow the extended portions 6 to protrude out from the inner channels 25. Although the internal frame 3 is shown to be generally square shaped, it is not limited to this configuration and is only limited by the need to rotate within the external framework 4, 5.

Figure 6:
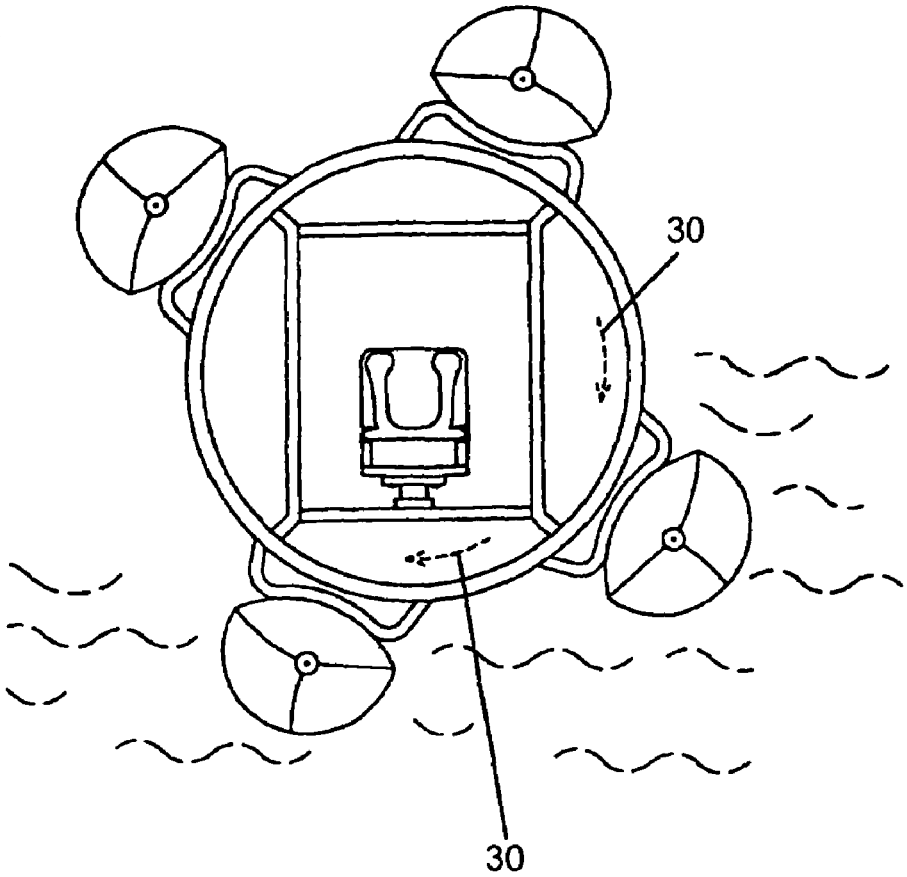
FIG. 6 is a diagrammatic, front-elevational view of the rollover boat illustrating a roll over condition.

In this manner the internal frame 3 is rotatably guided within the inner channels 25 of the rings 4. The roller bearings 16 are adjustable roller bearings 16. More specifically, the rolling friction of the roller bearings 16 can be adjusted to determine what amount of force must be exerted before the roller bearings 16 will start to move within the inner channels 25. In this manner, a user can customize the roll rate of the roller bearings 16 and ideally can customize the roll rate while in use and up to the point of locking the roller bearings 16 in place. Because the internal frame 3 is guided in the inner channels 25 by the roller bearings 16, the internal frame 3 has the ability to maintain a vertical or upright position as the rollover boat 1 experiences roll over conditions. In FIG. 6, arrows 30 show how the internal frame 3 compensates for a rollover condition and maintains an alignment in the upright position.

Figure 4:
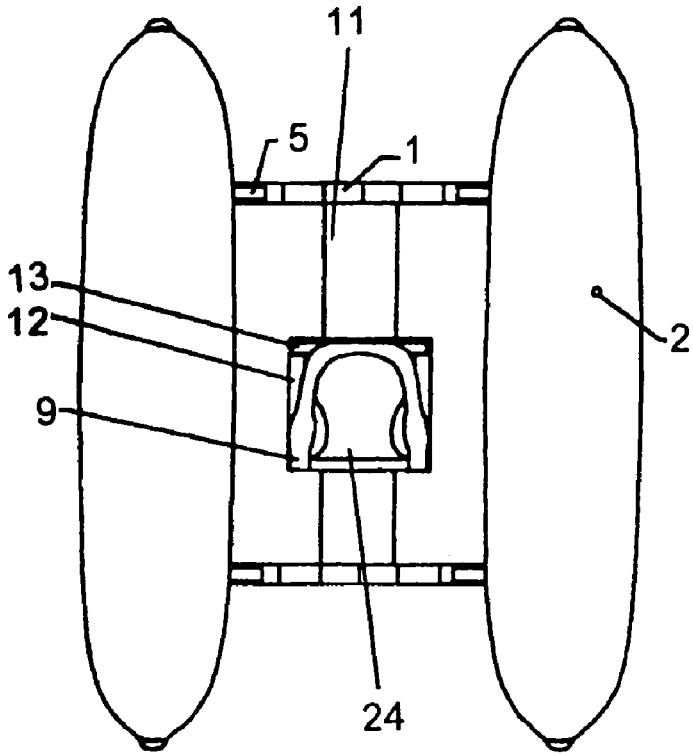
FIG. 4 is a diagrammatic, top plan view of the rollover boat.
Figure 5:
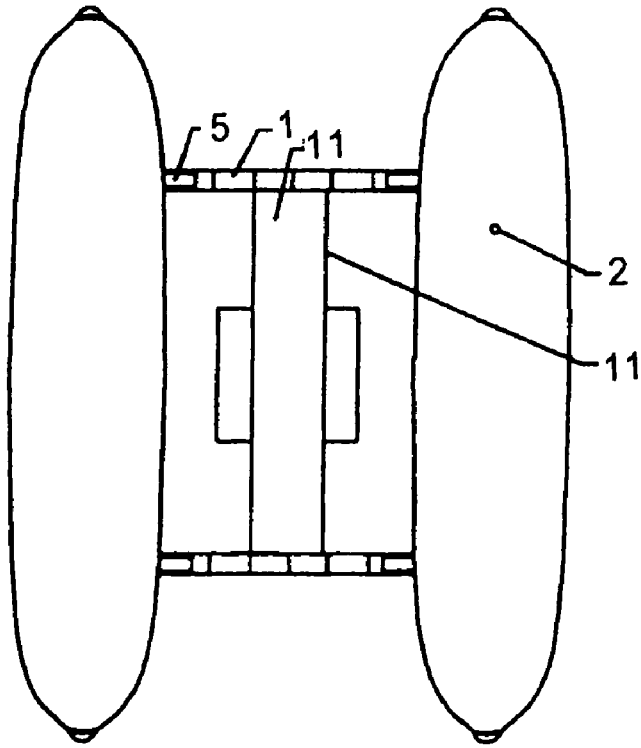
FIG. 5 is a diagrammatic, bottom plan view of the rollover boat.

As shown best in FIGS. 4 and 5, the internal frame 3 has a floor 11 upon which a passenger seat assembly 24 is supported. The lower portion of the internal frame 3, including the floor 11 and adjoining members are ideally formed heavier than a rest of the assembly thus facilitating the rolling of the internal frame 3 in the external framework 4. Preferably, the floor 11 itself is constructed thicker than structurally necessary and functions as a counter weight for assisting the internal frame 3 to roller in the inner channels 25. Additionally, weights can be added to adjust the roll rate.

Figure 2:
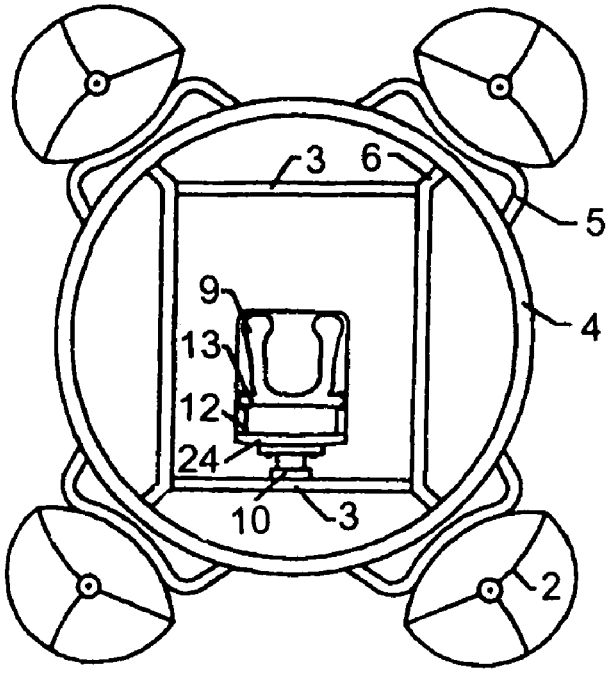
FIG. 2 is a diagrammatic, front-elevational view of the rollover boat.
Figure 3:
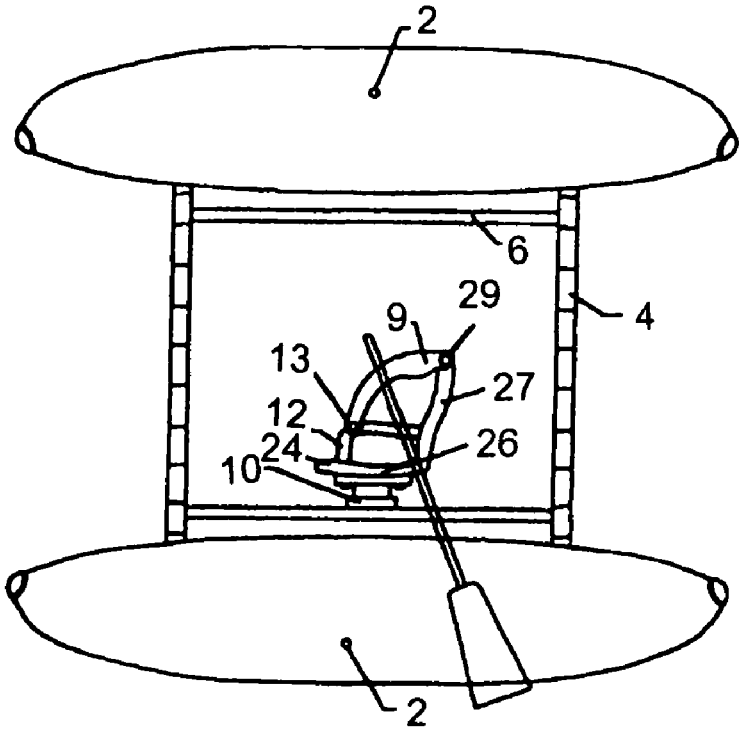
FIG. 3 is a diagrammatic, side-elevational view of the rollover boat.

As further shown in FIGS. 2 and 3, the passenger seat assembly 24 is mounted within the internal frame 3 and therefore, the passenger seat assembly 24 is also maintained in the upright position due to the movement of the internal frame 3 within the rings 4. The seat assembly 24 includes a seat bottom 26, a seat back 27, a bottom revolving mechanism supporting the seat assembly 24 on the internal frame 3, and a safety harness 9 that securely fastens the user and further allows the user to keep facing forward in case the boat is turned around.

Figure 10:
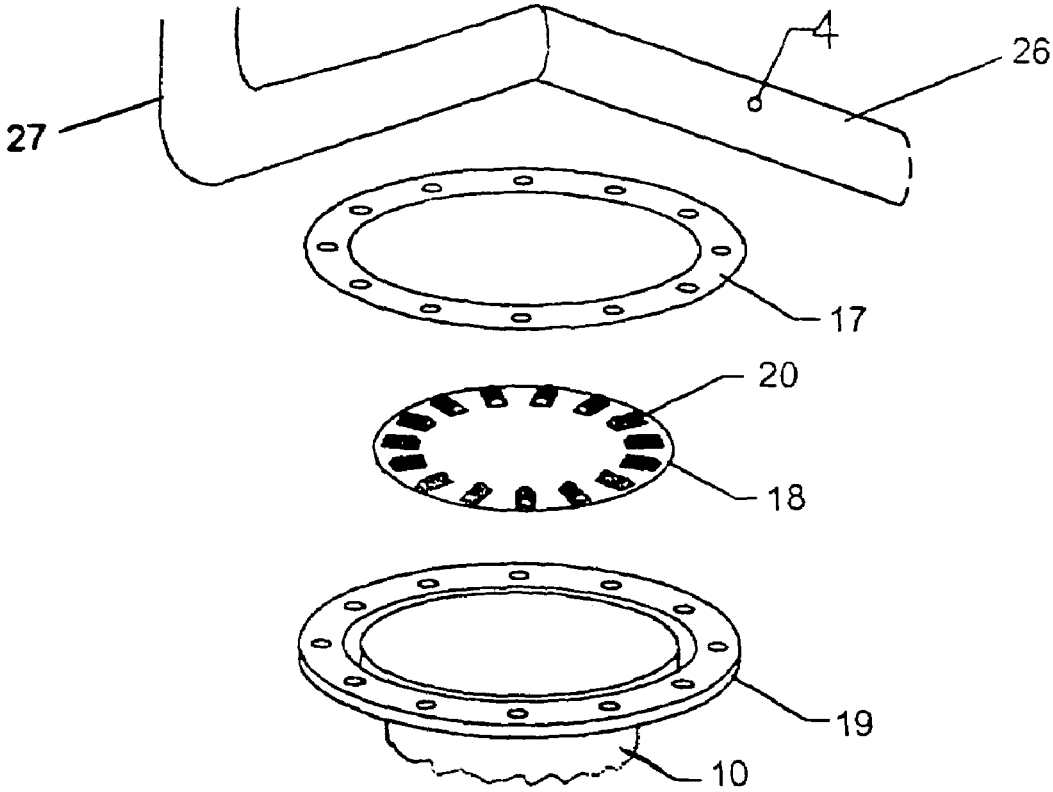
FIG. 10 is a diagrammatic, exploded perspective view of a seat assembly.
Figure 11:
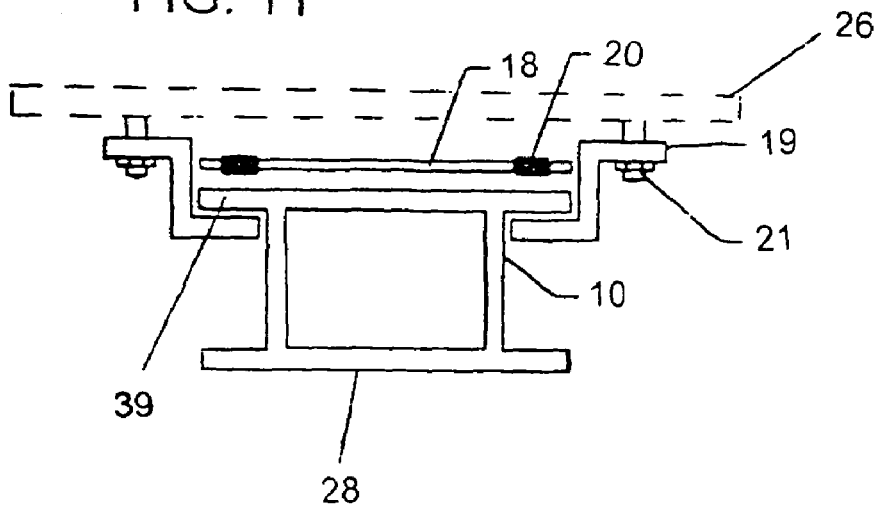
FIG. 11 is a diagrammatic, sectional view through the seat assembly.

As shown in FIGS. 10 and 11, a flange 10 in a form of a round outcropped flange 10 is fixedly attached to the floor 11 of the internal frame 3 by a bottom portion 28 of the flange 10. A top portion 39 of the flange 10 is contained within a support ring 19. The support ring 19 is secured to an attachment device 17 of the seat bottom 26 by fasteners 21. Disposed between the flange 10 and the seat bottom 26 is a holding plate 18 containing a plurality of round bearings 20. In this manner the seat bottom 26 can rotate 360 degrees as the user desires.

The safety harness 9 is formed of an internal structure draped with a soft padding and a first part of a locking mechanism 13. The internal structure may be formed of steel, aluminum, composites, hardened plastics and the like. The safety harness 9 is hinged to the seat back 27 and when in the unlocked position can pivot about a hinge 29 for allowing easy access to the seat bottom 26. A padded arm rest assembly 12 functions as a lower cage for the user and extends from a front of the seat bottom 26 to the seat back 27. A second part of the locking mechanisms 13 is integrated in the armrest 12 and locks to the first part of the locking mechanism 13 of the safety harness 9. The safety harness 9 in conjunction with the armrest 12 fully secures the user in the seat assembly 24. The locking mechanism 13 has a manual release in addition to a built in emergency release upon detection of prolonged submersion of a lower part of the seat assembly 24.

Because the rollover boat 1 has a rotatable seat assembly 24, being rotatable within the rings 4 and also 360 degrees about its own axis, the user is maintained at all times in an upright position and can rotate around for a full 360 degrees viewing. Therefore, the rollover boat 1 is ideally constructed for white water conditions including traversing waterfalls and of course rough seas in general.

Figure 12:
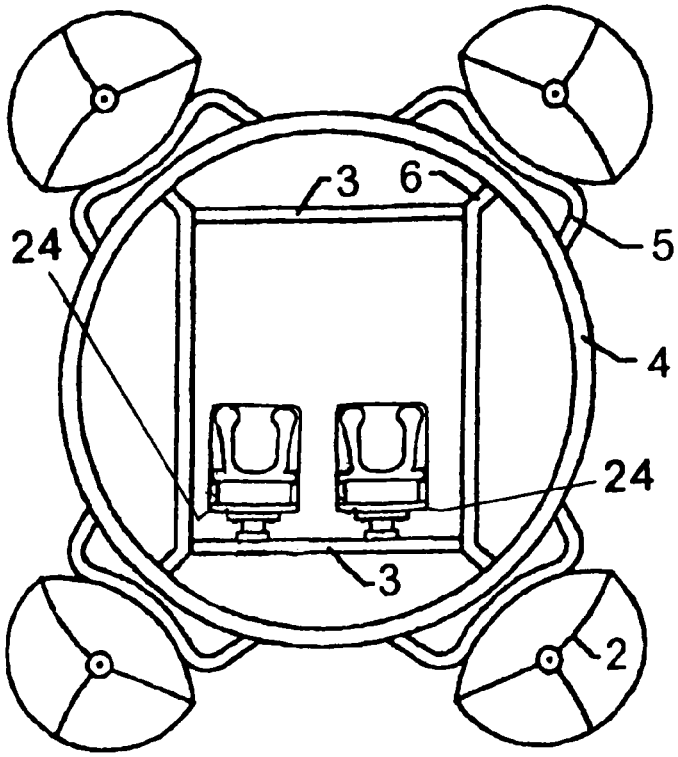
FIG. 12 is a diagrammatic, front-elevational view of the rollover boat showing tandem seats.
Figure 13:
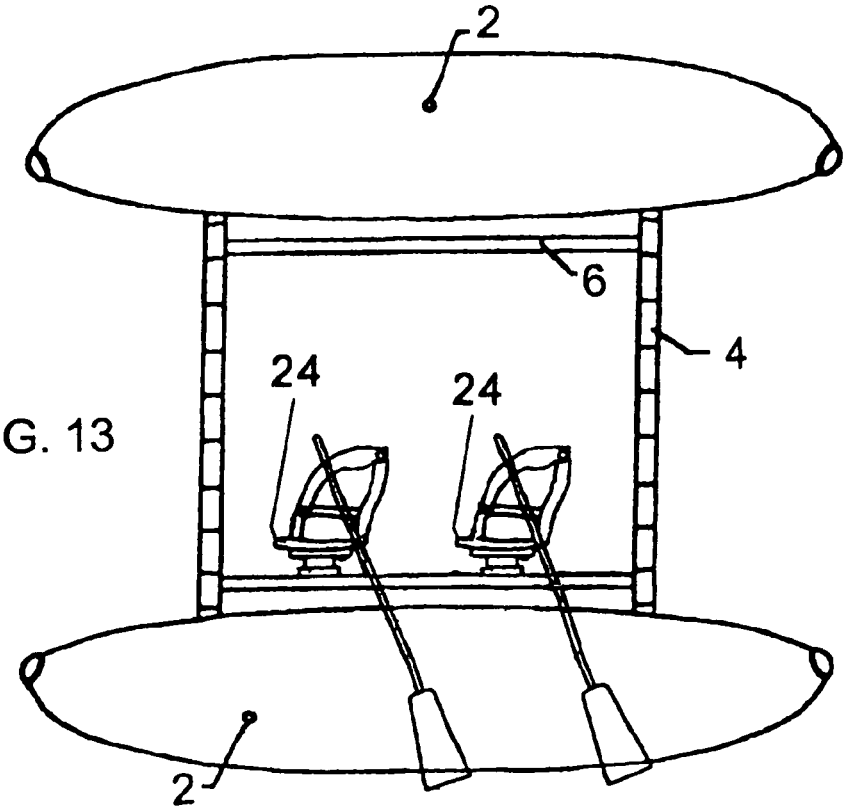
FIG. 13 is a diagrammatic, side-elevational view of the rollover boat having four seats.

FIGS. 12 and 13 show additional configurations of the rollover boat. FIG. 12 shows the rollover boat having two seats disposed next to each other. FIG. 13 shows a configuration of four seats, where one can only see the left side seats in the view as the two right side seats are hidden from the view shown in FIG. 13. It is contemplated within the invention of having one, two, three, four or more seats. For instance, the boat could be used for a guided tour, with a guide and many passengers.

I claim:

1. A boat, comprising:

an external frame having partially enclosed channels formed therein, said partially enclosed channels defined by U-shaped sides with an opening formed between said U-shaped sides;

an internal frame disposed for moving within said external frame, retained in said partially enclosed channels, and cannot be dislodged from said partially enclosed channels, said internal frame having roller bearings running in said partially enclosed channels and said roller bearings are retained in said U-shaped sides, said roller bearings being adjustable to control a roll rate of said roller bearings;

a seat assembly attached to said internal frame and maintained in an upright position by movement of said internal frame within said external frame; and at least three buoyancy chambers attached to said external frame.

2. The boat according to claim 1, wherein a number of said buoyancy chambers is selected from the group consisting of 4, 5, 6, 7 and 8.

3. The boat according to claim 2, wherein said number of buoyancy chambers is four.

4. The boat according to claim 1, wherein said buoyancy chambers are one of solid buoyancy chambers and inflatable buoyancy chambers.

5. The boat according to claim 1, wherein said seat assembly is rotatably mounted on said internal frame.

6. The boat according to claim 5, wherein:

said internal frame has a floor; and said seat assembly has a bottom revolving mechanism fixed to said floor and a seat supported by said bottom revolving mechanism.

7. The boat according to claim 6, wherein said bottom revolving mechanism has a flange attached to said floor and a support attached to said seat, said support rotating about said flange.

8. The boat according to claim 7, wherein:

said seat has a seat bottom and a seat back extending from said seat bottom; and said seat assembly has an attachment attached to said seat bottom, said support connected to said attachment allowing said seat to rotate 360 degrees.

9. The boat according to claim 6, wherein said seat assembly contains a safety harness assembly attached to said seat for securing a user in position in said seat.

10. The boat according to claim 9, wherein:

said seat has a seat bottom and a seat back extending from said seat bottom; and said safety harness assembly has a safety harness hinged to said seat back and an armrest attached to and extending from a front portion of said seat bottom to said seat back.

11. The boat according to claim 10, wherein:

said safety harness and said armrest are both padded; and said safety harness assembly containing a locking mechanism for locking said safety harness to said armrest.

12. The boat according to claim 1, wherein said external frame and said internal frame are made from a material selected from the group consisting of metals, plastics and composites.

13. The boat according to claim 1, wherein said seat assembly is one of a plurality of seat assemblies attached to said internal frame.

14. A boat, comprising:

an external frame having two rings and cross members connecting said rings to each other forming a cylindrically shaped external frame, said external frame further having a plurality of buoyancy frames fixed on said rings and further cross members connected between each pair of said buoyancy frames;

an internal frame disposed for moving within said external frame;

a seat assembly attached to said internal frame and maintained in an upright position by movement of said internal frame within said external frame; and at least three buoyancy chambers attached to said buoyancy frames of said external frame.

15. The boat according to claim 14, wherein:

said rings have inner channels formed therein; and said internal frame has roller bearings running in said inner channels.

16. The boat according to claim 14, wherein each of said buoyancy chambers has a least one releasable strap for releasably securing said buoyancy chambers to said further cross members.

* * * * *